US005829109A

United States Patent [19]

Kuroyanagi

[11] Patent Number: 5,829,109

[45] Date of Patent: Nov. 3, 1998

[54] STOCKER FOR WIRE HEALDS

[75] Inventor: Kazunori Kuroyanagi, Shizuoka-ken, Japan

[73] Assignee: Hamamatsu Photonics K.K., Hamamatsu, Japan

[21] Appl. No.: 782,890

[22] Filed: Jan. 10, 1997

[30] Foreign Application Priority Data

Jan. 12, 1996 [JP] Japan ..... 8-004297

[51] Int. Cl.[6] ..... D03J 1/14

[52] U.S. Cl. ..... 28/205; 221/278

[58] Field of Search ..... 221/212, 278, 221/312 A, 111, 107, 40; 28/205, 206, 201, 202, 203.1, 207; 271/283, 901, 18.1, 99, 102, 132, 141

[56] References Cited

U.S. PATENT DOCUMENTS

| | | | |
|---|---|---|---|
| 5,174,000 | 12/1992 | Wilhelm et al. | 28/205 |
| 5,475,906 | 12/1995 | Magdika | 28/205 |

FOREIGN PATENT DOCUMENTS

| | | | |
|---|---|---|---|
| 0 298 696 | 1/1989 | European Pat. Off. . | |
| 544585 | 9/1922 | France . | |
| 31-2391 | 5/1956 | Japan . | |
| 32-1378 | 2/1957 | Japan . | |
| 47-31387 | 8/1972 | Japan . | |
| 48-13660 | 2/1973 | Japan . | |
| 64-20359 | 7/1987 | Japan . | |
| 4-49189 | 11/1992 | Japan . | |
| WO 93/18215 | 9/1993 | WIPO | 28/205 |

*Primary Examiner*—Andy Falik
*Attorney, Agent, or Firm*—Pillsbury Madison & Sutro LLP

[57] ABSTRACT

A stocker for wire healdes comprising a housing constructed and arranged such that a plurality of wire healds can be stacked on top of one another in a vertical direction and be arranged so as to longitudinally extend in a horizontal direction. The housing includes a heald refilling aperture at an upper portion and a heald drawing opening at a lower front portion. The heald drawing opening is positioned and configured such that a lowermost one of said plurality of wire healds can be discharged therethrough.

17 Claims, 17 Drawing Sheets

STOCKER FOR WIRE HEALDS

BACKGROUND OF THE INVENTION

1. Field of the Invention

The present invention relates to a stocker for wire healds utilized in a warp passing apparatus for passing a warp through a mail of wire heald.

2. Related Background Art

An example of conventionally existing stockers for flat healds (which are also called magazines) is the one as described in the bulletin of Japanese Laid-open Patent Application No. 64-20359. The stocker disclosed in this bulletin is provided with an upright, platelike, fixed member extending vertically, and a pair of upper and lower magazine bars extending horizontally and fixed at one end to this fixed member. Then, guide holes of ring portions provided at the both ends of flat healds are put through the magazine bars, whereby the upright flat healds are stacked along the horizontal direction. In this way, many flat healds are stocked in the stocker.

However, the above-stated technology is related to stockers used for flat healds, but not to stockers for wire healds. Namely, a flat heald A is integrally made of SUS 420 or the like having a spring property and, as shown in FIG. 22, has a flat, slender rod portion 1 of a rectangular cross section. A mail 2 is formed at the middle of this rod portion 1. Ring portions 3 are provided at the both ends of this rod portion 1 and a guide hole 4 of an elongate hole shape is formed in each ring portion 3. Further, this flat heald A bends easily in the direction of an arrow, has characteristics of being strong against torsion and being resistant to deformation, and is durable. However, when the flat healds A are used in a weaving machine, necessary flat healds A are several thousand units to fifteen thousand units, and a bundle of these flat healds A become very heavy, resulting in a drawback of being hard to handle. Further, the cost per flat heald A is relatively high, and heavy expenditure is required to purchase flat healds A necessitated in the weaving machine.

In contrast with it, the wire healds B are made of hard drawn steel wire (60 carbon) and, as shown in FIG. 23, a wire heald has a slender rod portion 5. Amail 6 is formed at the middle of this rod portion 5. Ring portions 7 are provided at both ends of this rod portion 5 and a guide hole 8 is formed in an elongate hole shape in each ring portion 7. Further, this wire heald B has characteristics of being very light in weight, easy to handle, and inexpensive. However, the wire healds B are very easy to bend, and this bendability causes them to become tangled with each other, resulting in a drawback of being hard to handle.

Thus, when the stocker for flat healds disclosed in the bulletin of Japanese Laid-open Patent Application No. 64-20359 is applied to the wire healds B. the wire healds B are kept in a suspended state, and then their bendability is harmful to the wire healds B so as to cause a mutually tangled state. Accordingly, the wire healds B are arranged in correct order near the ring portions 7 in which the magazine bars are inserted, whereas they are tangled with each other near the mails 6 to be arranged in irregular order. As a result, it is a present status that the wire healds B cannot be drawn out as being separated one by one from the tip of the magazine bars because of entanglement among the wire healds B and because they are thin wires.

In addition, the conventional stocker for flat healds employs the magazine bars extending horizontally with one end being fixed to the platelike fixed member and with the other end being a free end. Therefore, for refilling flat healds A into the stocker, the refilling operation of flat healds A is not easy as it is hindered by a chuck mechanism for drive of healds disposed in front of the free ends of the magazine bars. Namely, at the magazine bars extending horizontally, the end for refilling of flat healds A results in coinciding with the end for drawing-out of flat healds A, which makes the refilling operation of flat healds A difficult. For employing such an arrangement as to perform the refilling of flat healds A with every magazine bars, a new arrangement for mounting and dismounting the magazine bars becomes necessary, which would be disadvantageous in terms of cost and structure.

SUMMARY OF THE INVENTION

The present invention has been accomplished in order to solve the above problems, and a specific object of the present invention is to provide a stocker for wire healds which insures stable stocking of wire healds and which also facilitates the refilling operation.

The present invention is a stocker for wire healds, which, in order to selectively discharge an arbitrary wire heald out of a lot of wire healds juxtaposed, is arranged to stock a lot of the wire healds, wherein the wire healds kept in a horizontal state are stacked vertically in a housing, a heald refilling aperture is provided at a top portion of the housing, and a heald drawing opening for discharging the lowermost of the wire healds stacked is provided at a lower front end in the housing.

In this stocker for wire healds, the wire healds are stacked vertically in the housing as being maintained in a horizontal state, whereby the heald refilling aperture can be provided at the top portion of the housing and the heald drawing opening can be provided at the lower front end of the housing. In this way, the aperture for refilling the wire healds and the opening for discharging the wire healds from the housing can be provided separately in the housing, which, upon the refilling operation of wire healds, permits the refilling operation to be performed from above the housing as utilizing the self-weight of healds or the like, thereby facilitating the filling operation of wire healds. Further, provision of the heald refilling aperture at the top portion of the housing permits one to perform the refilling operation as looking into this aperture from the top. Also, provision of the heald drawing opening at the lower front end of the housing permits the guide hole of the lowermost wire heald to be hooked on a pin or the like, whereby the wire heald can be drawn horizontally.

Also, a pair of front and rear floating rods, inserted through either guide hole of a pair of ring portions formed at the both ends of the wire healds and extending vertically, are disposed in the housing. Lower end faces of the floating rods are disposed in contact with a heald receiving bottom surface of the housing. Also, the floating rods are arranged to travel vertically in the housing, whereby entanglement of wire healds can be prevented in the stocker.

A tapered ring lead-in portion for leading the ring portion into between the lower end face of the floating rod and the heald receiving bottom surface is preferably formed at a rear part in the lower end face of the floating rod. Further, a horizontally cut ring leading portion is preferably formed at rear and front parts in the lower end face of the floating rod in order to pull the ring portion to between the lower end face of the floating rod and the heald receiving bottom surface. In addition, the housing may also be provided with a heald front end separating portion having a pair of right and left push claws disposed below the front-side floating rod and arranged to engage with the ring portion of the wire heald in which the front-side floating rod is inserted and with the lower end face of the front-side floating rod to push the front-side ring portion and the front-side floating rod up from the bottom.

Preferably, each push claw comprises a claw portion extending horizontally to engage with the lower end face of the floating rod and with the ring portion, and a support portion for supporting this claw portion and wherein tip portions of the claw portions located right and left are spaced from each other. Also, a taper surface is formed at the tip of the claw portion, a claw engaging recess for the tip portion of the claw portion to be inserted therein is formed in the lower end face of the floating rod, and a taper surface fitting with the taper surface of the claw portion is formed in an upper surface of the claw engaging recess.

Further scope of applicability of the present invention will become apparent from the detailed description given hereinafter. However, it should be understood that detailed description and specific examples, while indicating preferred embodiments of the invention, are given by way of illustration only, since various changes and modifications within the spirit and scope of the invention will become apparent to those skilled in the art from this detailed description.

From the invention thus described, it will be obvious that the invention may be varied many ways. Such variation are not to be regarded as a departure from the spirit and scope of the invention, and all such modifications as would be obvious to one skilled in the art are intended to be included within the scope of the following claims.

DESCRIPTION OF THE PREFERRED EMBODIMENTS

The preferred embodiments of the stocker for wire healds according to the present invention will be described in detail with reference to the drawings.

Figure 1:
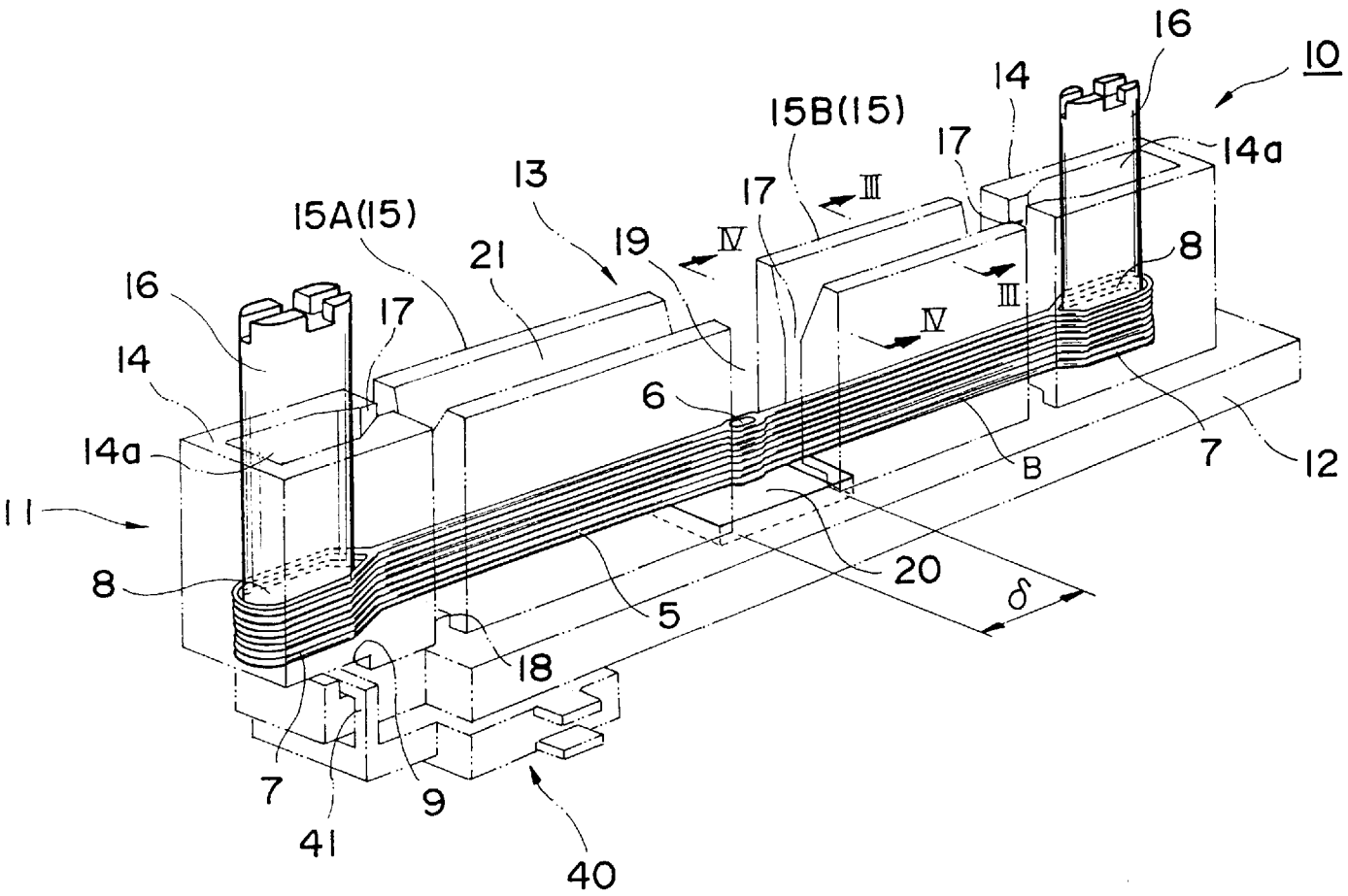
FIG. 1 is a perspective view to show an embodiment of the stocker for wire healds according to the present invention.

FIG. 1 is a perspective view to show a horizontal placement type stocker for wire healds according to the present embodiment. The wire heald stocker 10 shown in the same figure has a housing 11 for keeping the wire healds B horizontal and layered in a vertical stack. This housing 11 is formed to be so slender as to match with the slender shape of wire healds B and comprises a flat base 12, a frame body 13 fixed as standing on this base 12, and a heald drawing opening 9 cut at the lower front end so as to be horizontally slender. This frame body 13 has ring receiving portions 14 located at the both ends thereof for receiving the ring portions 7 of wire healds B. and a rod receiving portion 15 located between these ring receiving portions 14, 14, for receiving the rod portions of wire healds B.

A bar-shaped floating rod 16 extending vertically is inserted in each ring receiving portion 14. The outer peripheral shape of each floating rod 16 is nearly identical to the inner peripheral shape of ring portion 7, thereby enabling stable stacking of wire~healds B. Further, the floating rod 16 is light in weight, and the surface thereof is mirror-finished to facilitate sliding of wire healds B and is processed by an anti-abrasion surface treatment to be resistant to scratches by the wire heald B. For example, the floating rod 16 is made by subjecting a surface of metal (steel, aluminum, or the like) processed in a predetermined shape to hard chromium plating.

Figure 2:
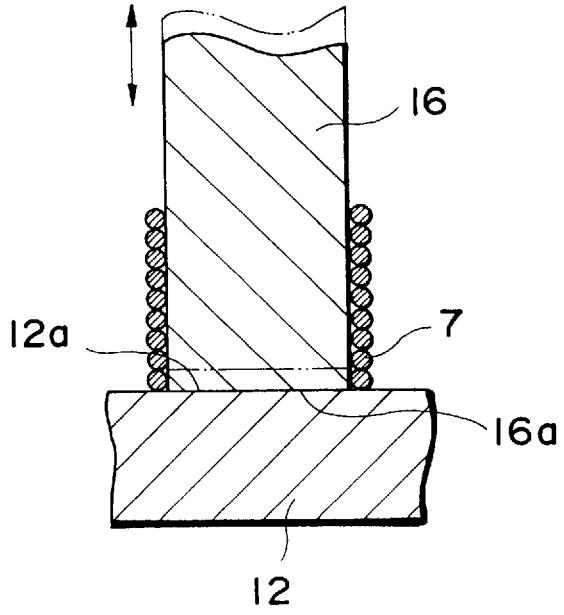
FIG. 2 is a cross-sectional view to show a state in which a floating rod is inserted in ring portions of wire healds.

As shown in FIG. 2, lower end faces 16*a* of the front and rear floating rods 16 are in contact with a heald receiving bottom surface 12*a* formed in the surface of base 12, and are urged against the heald receiving bottom surface 12*a* by the self-weight of floating rod 16. Namely, this floating rod 16 is simply stuck into the ring receiving portion 14 from the top, so that it is vertically free relative to the base 12. Accordingly, the floating rod 16 can travel vertically (in directions of arrows) in the ring receiving portion 14 of housing 11.

Use of this floating rod 16 includes such effects that the wire healds B can be vertically arranged in correct order by the self-weight of wire healds B stacked, that, at the same time, this state can be always maintained, and that entanglement between wire healds B can be decreased to be very rare. Further, since the floating rod 16 can maintain the ring~portions 7 horizontal, it makes horizontal drawing of wire heald B extremely easier.

In addition, the floating rod 16 is kept in a simply contact state with the heald receiving bottom surface 12*a* of the base 12 by the self-weight thereof. Thus, when the lowermost wire heald B is drawn horizontally, the ring portion 7 of wire heald B intrudes into a tapered ring lead-in portion 16*c* (see FIG. 8) of the floating rod 16 as detailed hereinafter, whereby the lower end face 16*a* of floating rod 16 can be pushed up readily. As a result, only the ring portion 7 is drawn out as it is pinched between the lower end face 16*a* of floating rod 16 and the heald receiving bottom surface 12*a*. Therefore, the ring portions 7 of wire healds B, except for those being drawn out can be maintained in such a condition that the floating rod 16 is inserted therein, and the wire heald B being drawn out forward pushes the floating rod 16 upwardly.

Further, as shown in FIG. 1, a ring receiving space 14*a* extending vertically is formed in the ring receiving portion 14 in order to receive the ring portions 7 in a stacked state. The upper part of this ring receiving space 14*a* is open for insertion of the floating rod 16 therein, and one side portion of the ring receiving space 14*a* is open is cut off in order to permit insertion of the rod portions 5 of wire healds B. Further, the ring receiving space 14*a* is formed so as to surround the floating rod 16, whereby the ring portions 7 can be received surely in the ring receiving portion 14 with the floating rod 16 being supported by the ring receiving portion 14 through the ring portions 7 of wire healds B.

Figure 3:
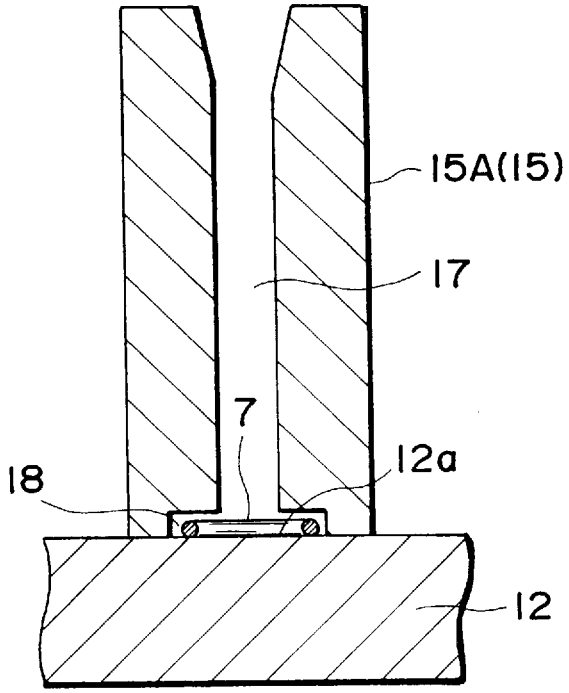
FIG. 3 is a cross-sectional view along line III—III of FIG. 1.

As shown in FIG. 1 and FIG. 3, a slender rod receiving slit 17 for receiving the rod portions 5 is formed in the longitudinal direction and at the center of the housing 11. This rod receiving slit 17 is formed on a straight line connecting the ring receiving spaces 14*a* at the both ends. In other words, the rod receiving slit 17 is formed throughout the entire length of the rod receiving portion 15 and in parts of the ring receiving portions 14. Formed at the lower end of the rod receiving slit 17 is a ring guide hole 18 for guiding a slide of the ring portion 7 of the lowermost wire heald B along the heald receiving bottom surface 12*a*.

This ring guide hole 18 is formed by horizontally expanding the lower end of the rod receiving slit 17 immediately above the heald receiving bottom surface 12*a*. The ring guide hole 18 is also slightly greater than the width of the ring portion 7, and has such a height as to permit only the lowermost ring portion 7 to pass. Further, the ring guide hole 18 is formed throughout the entire length of the rod receiving slit 17, whereby the wide ring portion 7 can be prevented from being caught in the housing 11. In addition, even if a slightly old wire heald B with the ring portion 7 a little twisted relative to the rod portion 5 is drawn out horizontally, the wire heald B can be drawn out stably in the horizontal direction, regardless of the twist of the ring portion 7. Further, when the lowermost wire heald B is drawn out, the rear ring portion 7 of the lowermost wire heald B is prevented from breaking into the rod portions 5 stacked in the rod receiving slit 17.

Figure 4:
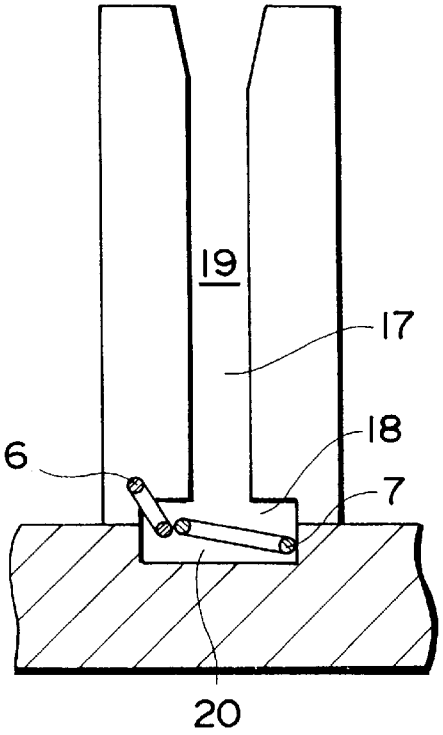
FIG. 4 is a cross-sectional view along IV—IV of FIG. 1.

As shown in FIG. 1 and FIG. 4, the rod receiving portion 15 of the housing 11 is divided into two front and rear parts, which are comprised of first rod receiving portion 15A and second rod receiving portion 15B. The rod receiving portion 15 is fixed on the base 12 so that the first rod receiving portion 15A and second rod receiving portion 15B are spaced from each other, whereby this space region can be utilized as a mail receiving space portion 19. Then, even in the case of the mails 6 being stacked in this mail receiving space portion 19, since the mail receiving space portion 19 has a space wide enough, the freedom for the mails 6 to move vertically and horizontally can be enhanced. Further, the heald receiving bottom surface 12*a* is provided with a heald escape recess 20 for expanding the lower part of the mail receiving space portion 19. Namely, the heald escape recess 20 opens the part below the lowermost mail 5, thereby further enhancing the freedom of the lowermost mail 5.

Figure 5:
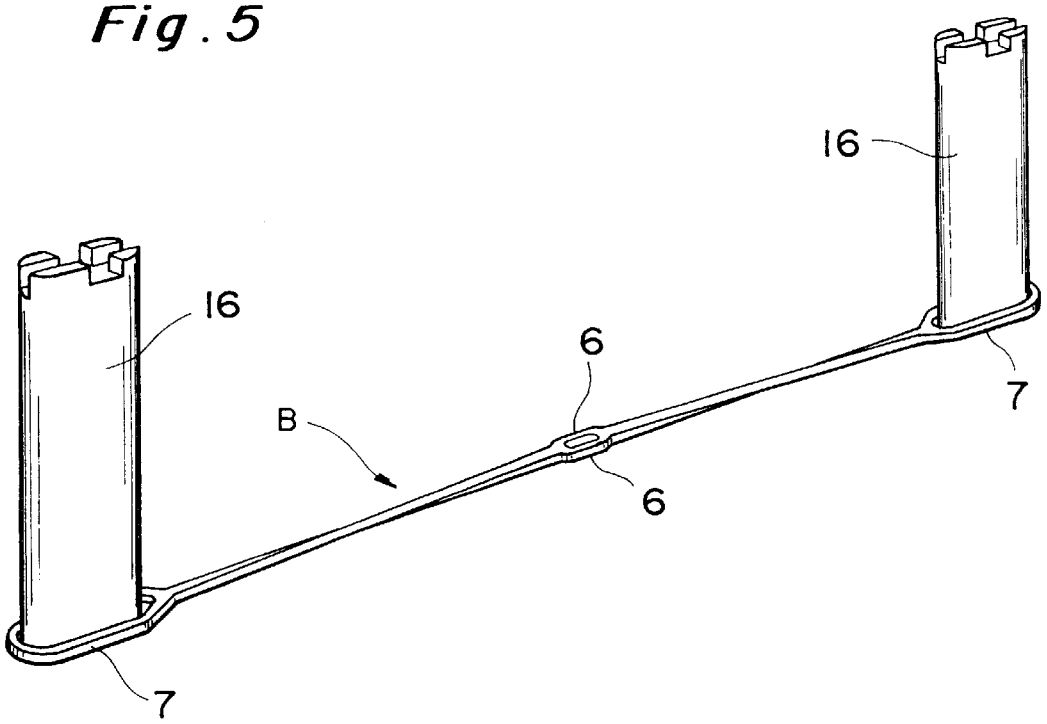
FIG. 5 is a perspective view to show a mutually tangled state of wire healds.

Thus, if upper and lower mails 6 become tangled with each other so as to reverse the upper and lower wire healds B near the mails 6 as shown in FIG. 5, horizontal drawing of the lowermost wire heald B will make the ring portion 7 under draw collide with the mail 6 as shown in FIG. 4, thereby canceling entanglement between the wire healds B as escaping from each other. Also, the spacing δ (see FIG. 1) between the first rod receiving portion 15A and the second rod receiving portion 15B forming the mail receiving space portion 19 is set shorter than the length of the ring portion 7, whereby before the rearmost end of the ring portion 7 leaving the ring guide hole 18 of the second rod receiving portion 15B becomes completely off in the region of the mail receiving space portion 19, the front end of the ring portion 7 (the connecting end between the ring portion 7 and the rod portion 5) can be pulled into the first rod receiving portion 15A. As a result, the wire heald can be conveyed stably as keeping the ring portion 7~horizontal in the mail receiving space portion 19, and in addition, escape of the mail 6 entangled with the wire heald B under draw can be effected certainly.

As shown in FIG. 1, a heald refilling aperture 21 extending horizontally is provided at the top portion of the frame body 13 of housing 11. This heald refilling aperture 21 is provided at a position different from that of a heald drawing opening 9 for drawing the wire heald B horizontally. Accordingly, upon refilling operation of wire healds B. the refilling operation can be performed as utilizing compressed air from the upper part of the housing 11, the self-weight of healds B. and so on, thus facilitating the refilling operation of wire healds B. Further, it permits one to perform the refilling operation while looking into this aperture 21 from the top. Also, the upper part of the rod receiving slit 17 provided in the rod receiving portion 15 of the frame body 13 is expanded in a funnel shape, which facilitates insertion of the wire healds B into the rode receiving slit 17.

Figure 6:
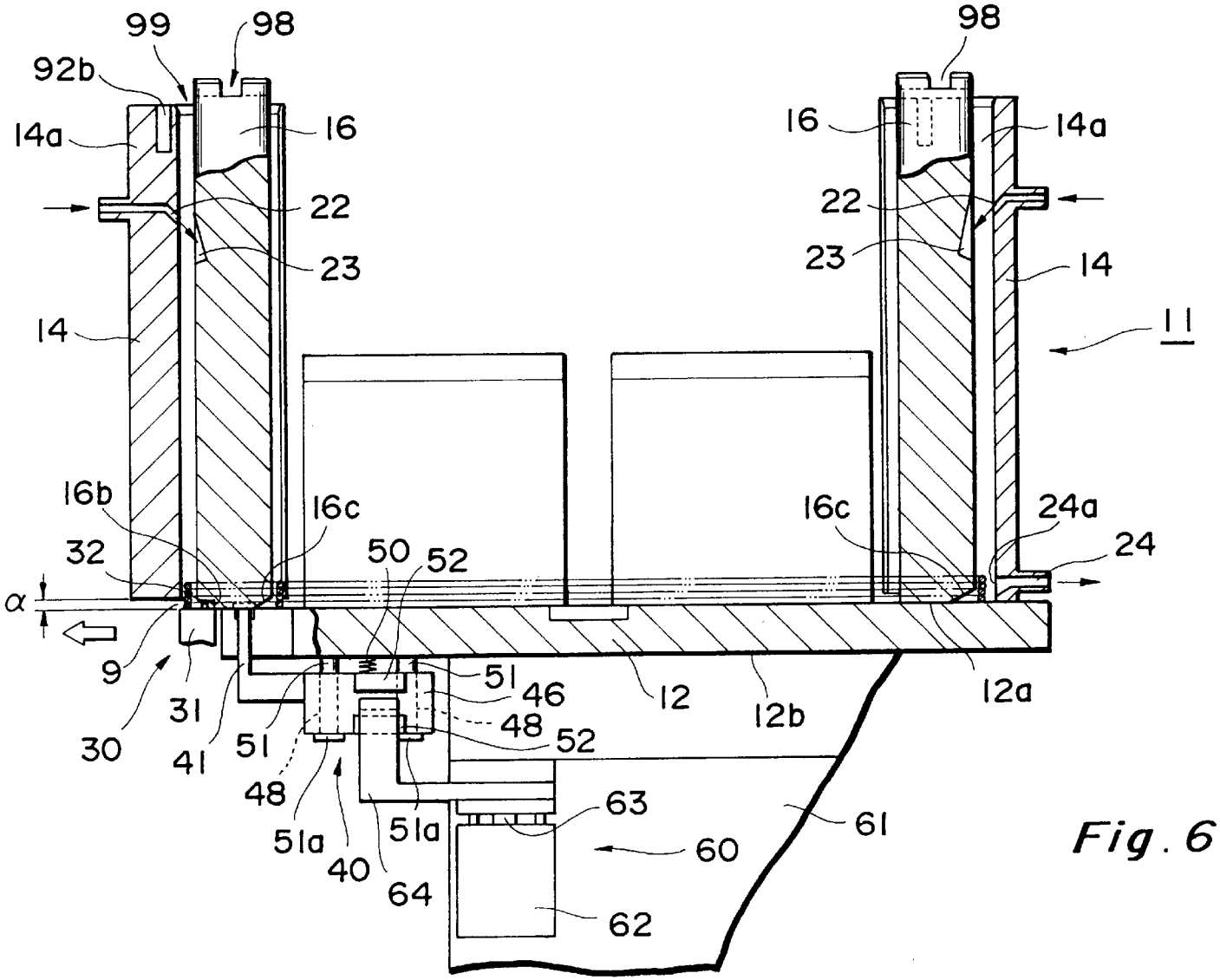
FIG. 6 is a longitudinal cross-sectional view of the stocker for wire healds according to the present, invention.

As shown in FIG. 6, an air blow-off port 22 for supplying compressed air from the outside into the ring receiving space 14*a* is provided in each upper part of the front and rear ring receiving portions 14, and each air blow-off port 22 blows off the compressed air obliquely from above toward the front and rear floating rods 16. Further, an air catch recess 23 cut in an L-shaped cross section is formed in the upper part of the floating rod 16, and this air catch recess 23 is provided at a position where it faces the air blow-off port 22.

Accordingly, since the compressed air blown off from the air blow-off port 22 continues pushing the air catch recess 23 obliquely from above it, predetermined downward pressure can be continuously applied to the floating rod 16, whereby the floating rod 16 can be prevented properly from jumping when the lowermost wire heald B is drawn out as being pinched between the lower end face 16*a* of the floating rod 16 and the heald receiving bottom surface 12*a*. Also, a descending current occurs in the ring receiving space 14*a* and this current can continuously push the ring portions 7 from the top. Thus, every time the wire heald B is drawn out, the ring portions 7 can forcibly be moved down in order along the floating rod 16, which can prevent the ring portions 7 from being caught by the floating rod 16 and thus from stopping.

Further, an air suction portion 24 for forcibly discharging the air in the ring receiving space 14*a* to the outside is provided in the lower part of the rear ring receiving portion 14, and his air suction portion 24 sucks the lower ring portions 7 mounted on the rear floating rod 16 backward. This backward suction by the air suction portion 24 is designed to cover several wire healds B stacked from the bottom, and a suction port 24*a* of the air suction portion 24 is expanded in a funnel shape toward the inside. Thus, use of the air suction portion 24 permits the air in the ring receiving space 14*a* to be evacuated continuously, whereby the several ring portions 7 from the bottom can continuously be drawn backward. Therefore, when the lowermost wire heald B is forcibly drawn out, the wire heald B under draw is prevented from taking the wire heald B immediately above it together, which enables sure and smooth drawing of wire heald B.

Figure 7:
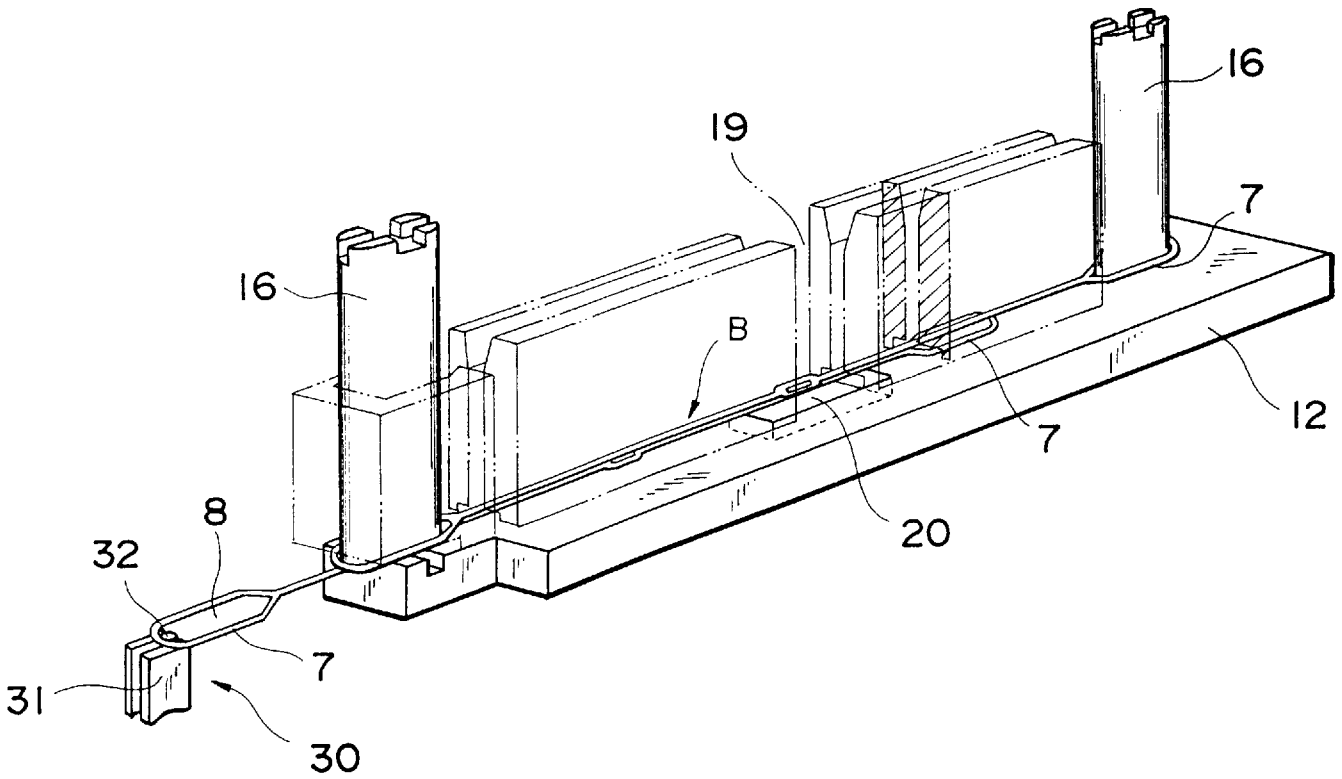
FIG. 7 is a perspective view to show a state in which the lowermost wire heald is drawn out of the stocker for wire healds.

Here, a heald drawing mechanism 30, for example as shown in FIG. 6 and FIG. 7, is provided as a means for drawing the flat healds A stacked in the stocker 10 one by one from the lowermost. This heald drawing mechanism 30 comprises a magnetic head 31 for draw of heald arranged to move up and down and comprised of an iron core forming a part of an electromagnet, a drawing pin 32 comprised of a non-magnetic member provided at the top part of this magnetic head 31, a piston mechanism (not shown) for moving the magnetic head 31 up and down, and a translational stage (not shown) for moving the magnetic head 31 horizontally.~

Therefore, the drawing pin 32 is located immediately below the guide hole 8 in the ring portion 7, and is inserted properly into the guide hole 8 by moving the magnetic head 31 up by the piston mechanism (see FIG. 6). At this time, the coil wound around the magnetic head 31 is energized to make the ring portion 7 magnetically attached to the magnetic head 31, thereby getting ready for drawing of wire heald B. Then, as shown in FIG. 7, the translational stage (not shown) draws the magnetic head 31 horizontally with hooking the lowermost ring portion 7 on the drawing pin 32, thereby achieving horizontal drawing of wire heald B.

Figure 8:
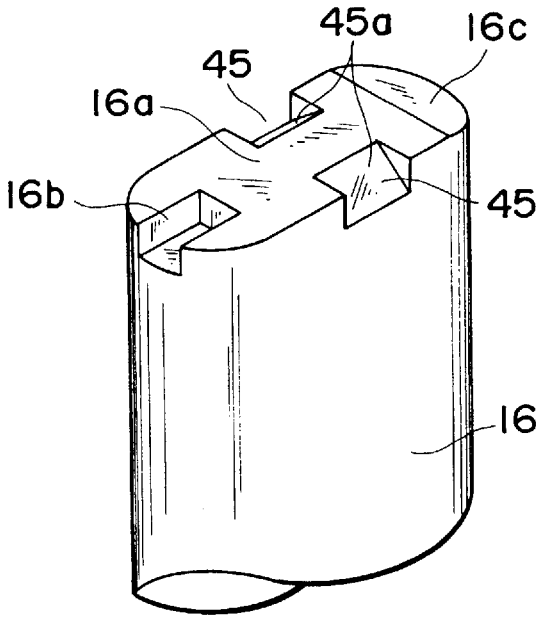
FIG. 8 is a perspective view to show the lower end portion of the front floating rod being a main part of the present invention.

As shown in FIG. 8, a notch portion 16*b* for the drawing pin 32 to be inserted therein from the bottom is provided in the front portion of the lower end face 16*a* of the front floating rod 16 in order to properly insert the drawing pin 32 in the guide hole 8 of the lowermost ring portion 7. Also, a tapered ring lead-in portion 16*c* is formed in the rear part of the lower end face 16*a* of the floating rod 16, and by this ring leading portion 16*c*, the ring portion 7 under draw can be led easily into between the lower end face 16*a* of the floating rod 16 and the heald receiving bottom surface 12*a*. However, a floating rod 16 without a notch portion 16*b* for drawing pin may be employed as the rear floating rod 16.

Moreover, as shown in FIG. 6, the height a of the heald drawing opening 9 is determined so as to permit only the lowermost wire heald B hooked on the drawing pin 32 to pass. Therefore, even if the second and higher wire healds B from the bottom are taken by friction together with horizontal drawing of the lowermost wire heald B while hooking the lowermost ring portion 7 on the drawing pin 32, the front ends of the ring portions 7 of the second and higher wire healds B from the bottom will come to collide with the front wall of the front ring receiving portion 14, so that only the lowermost wire heald B can be drawn out of the heald drawing opening 9.

Figure 9:
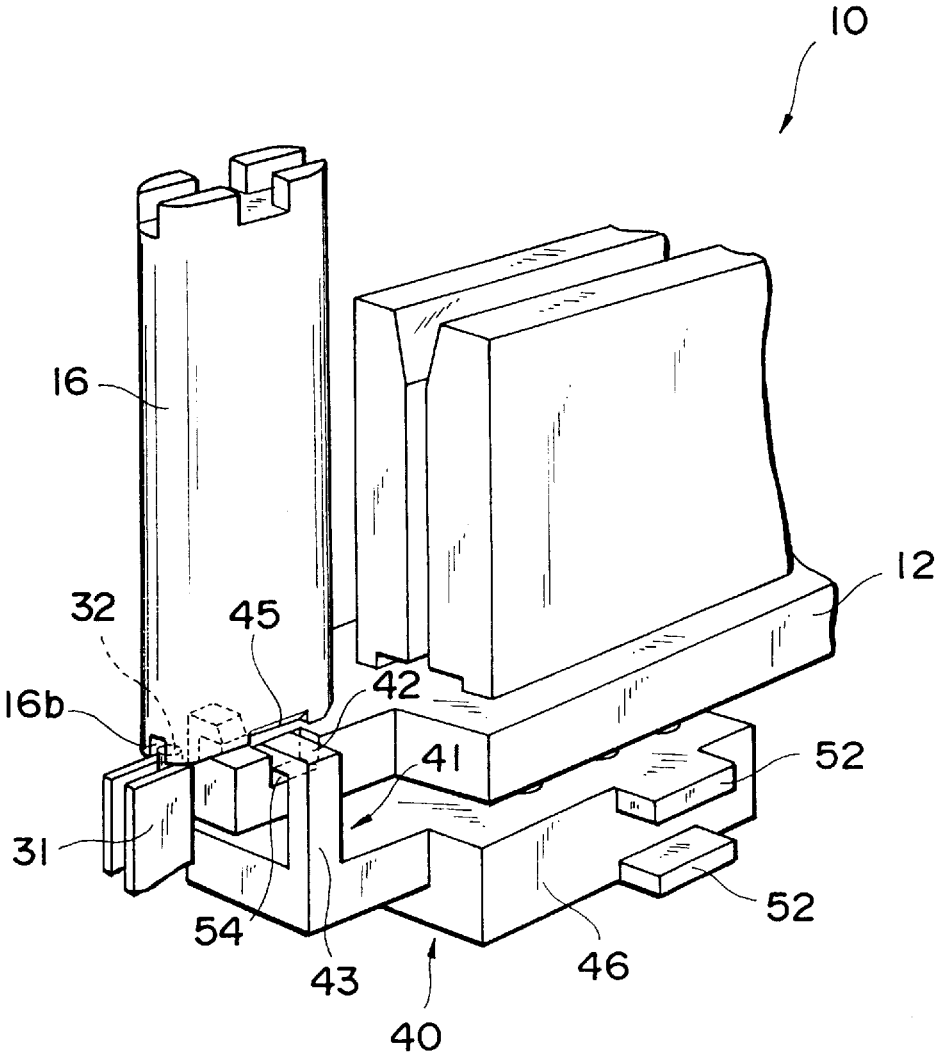
FIG. 9 is a perspective view to show the heald front end separating portion provided in the stocker for wire healds according to the present invention.
Figure 10:
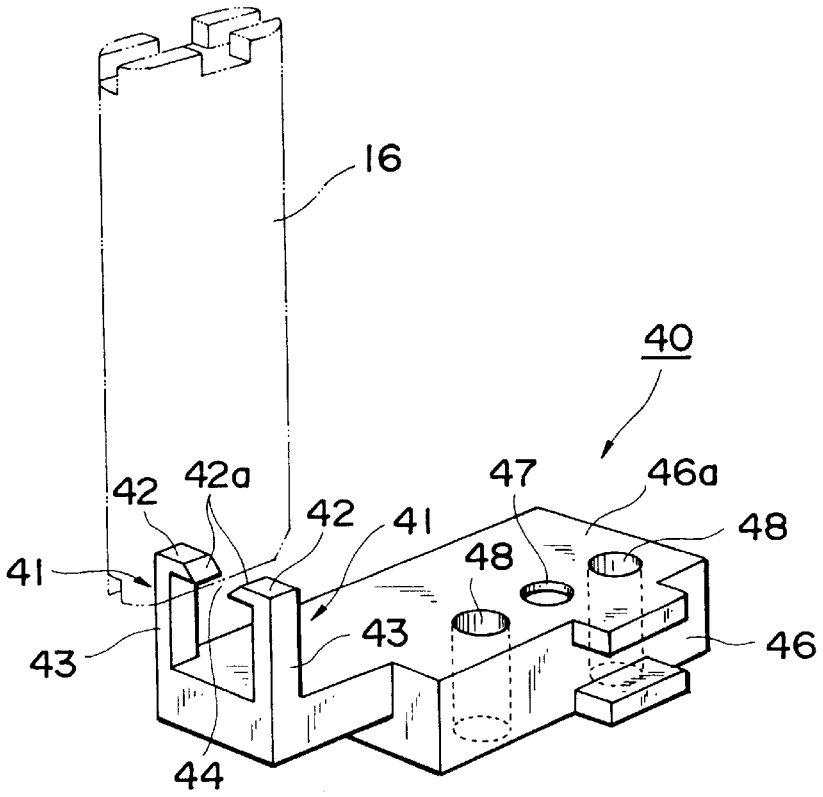
FIG. 10 is a perspective view to show the positional relation between the heald front end separating portion and the floating rod.
Figure 11:
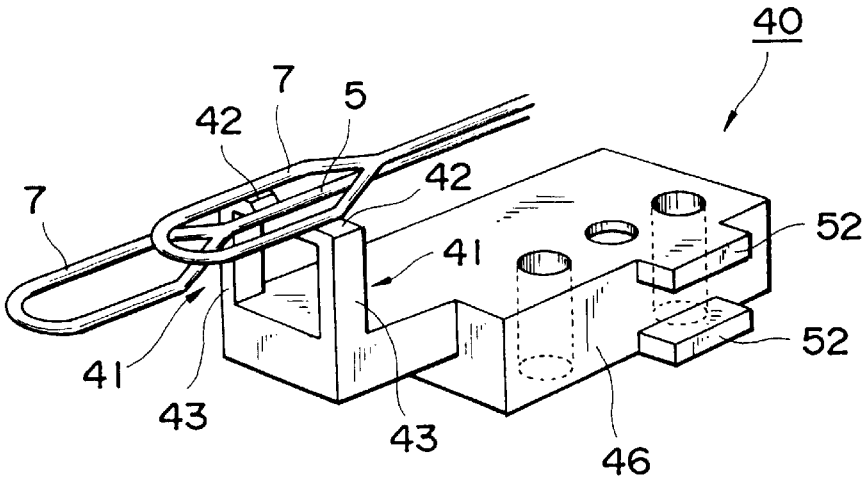
FIG. 11 is a perspective view to show a state in which the lowermost wire heald is drawn slightly by the drawing pin upon separation of wire heald.

Next, as shown in FIG. 1, FIG. 6, and FIG. 9, the wire heald stocker 10 is provided with a heald front end separating portion 40 forming a heald pusher as a lift head in order to assure more certain drawing of the lowermost wire heald B. This heald front end separating portion 40 has push claws 41 located below the front floating rod 16, as shown in FIG. 10 and FIG. 11. The push claws 41 are formed in an L-shape and are paired right and left. Each push claw 41 comprises a claw portion 42 extending horizontally and arranged to engage with the lowermost ring portion 7 mounted on the front floating rod 16 and kept at that position, and a support portion 43 extending downward from the base end of the claw portion 42 in order to support this claw portion 42.

A gap 44 is formed between the claw portions 42, 42 by spacing the tip portions (free end portions) of the right and left claw portions 42, 42 from each other, and this gap 44 is formed a little larger than the diameter of the rod portion 5 of wire heald B. A taper surface 42*a* inclined obliquely downward toward the tip is formed at the tip portion of each claw portion 42. Since upon ascent of the push claws 41 the tip end portions of the claw portions 42 come to be inserted into claw engaging recesses 45 formed in the lower end face 16*a* of the front floating rod 16, a taper face 45*a* to match with the taper face 42*a* of the claw portion 42 is formed in the top surface of each claw engaging recess 45 (see FIG. 8). Since the claw portions 42 need to be buried perfectly in the base 12 upon descent of the push claws 41, claw receiving recesses 54 are formed in the front-end-side top surface of the base 12, as shown in FIG. 9. In the case where the rear floating rod 16 is designed not to be moved vertically by the push claws 41, the rear floating rod 16 does not always have to be provided with the foregoing claw engaging recesses 45.

Further, as shown in FIG. 6 and FIG. 9, the heald front end separating portion 40 has a base portion 46 for fixing each L-shaped push claw 41 in a standing state, and this base portion 46 is located below the base 12. A recessed portion 47 for a spring to be seated therein is formed in a top surface 46*a* of this base portion 46, and pin inserting holes 48 vertically piercing the base portion 46 are formed on either side of the recessed portion 47 (see FIG. 10). The top surface 46*a* of the base portion 46 and the bottom surface 12*b* of the base 12 are connected through a compression spring 50 seated in the recessed portion 47, and this compression spring 50 urges the base portion 46 in the direction to depart from the base 12. Then, two pins 51 project downward from the bottom surface 12*a* of the base 12, the pins 51 are inserted in the pin inserting holes 48 of the base portion 46, and stopper portions 51*a* comprised of snap rings or the like are provided at the lower end of the pins 51 whereby the base portion 46 can move up and down in the extending direction of the pins 51 under elasticity of the spring 50. A pair of upper and lower tongues 52 to be engaged with an actuator member 64 described hereinafter are provided in the base portion 46 so as to project therefrom (see FIG. 9).

Here, a driver 60 moves the base portion 46 up and down, as shown in FIG. 6. This driver 60 comprises an air cylinder 62 fixed to a support stage 61 for supporting the base 12 of the housing 11, a cylinder rod 63 arranged to reciprocate vertically in a predetermined stroke relative to this air cylinder 62 and prevented from rotating, and an actuator member 64 fixed to the tip end of this cylinder rod 63 and engaged with the tongues 52 of the base portion 46 at the tip end thereof. Accordingly, the base portion 46 can be moved up and down by a predetermined amount in accordance with the stroke amount of the cylinder rod 63. Since the actuator member 64 is given a play between the tongues 52 when the tip end of the actuator member 64 is inserted between the tongues 52, the stroke amount of the cylinder rod 63 is not equal to an ascent amount of the base portion 46.

Next explained is the operation of the heald front end separating portion 40.

Figure 12:
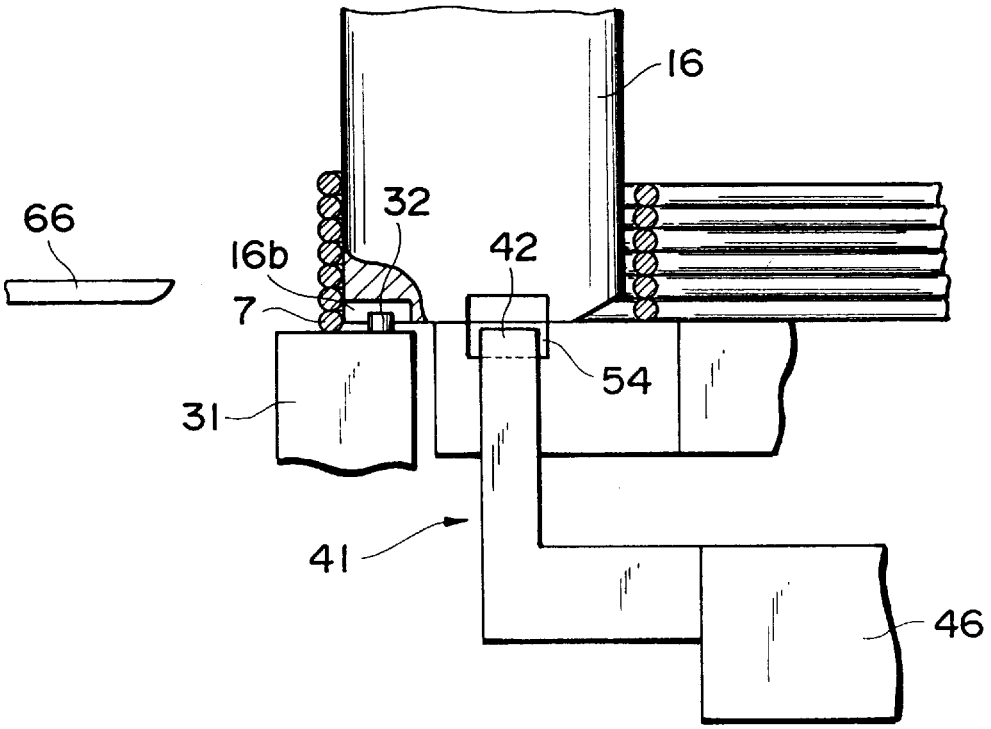
FIG. 12 is a partly enlarged side view to show a state before drawing of the lowermost wire heald.
Figure 13:
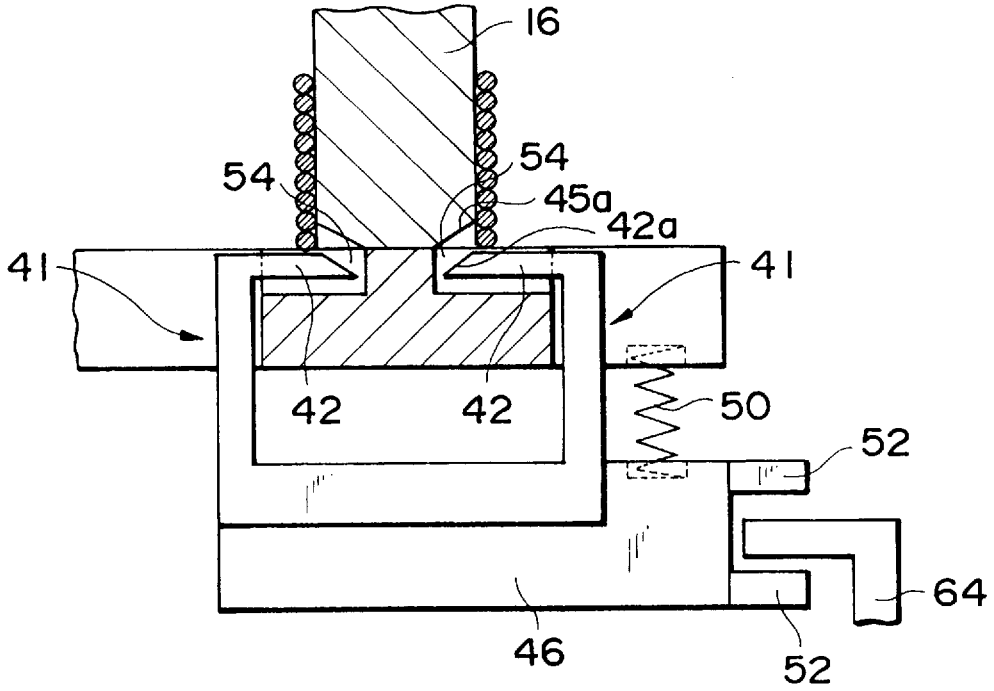
FIG. 13 is a transverse cross-sectional view of FIG. 12.

As shown in FIG. 12 and FIG. 13, prior to draw of the lowermost wire heald B. first, the drawing pin 32 is inserted into the notch portion 16*b* of the front floating rod 16 and at the same time as it, the ring portion 7 of the lowermost wire heald B is made to be magnetically attached to the magnetic head 31. Since the claw portions 42 of the push claws 41 are completely buried in the claw receiving recesses 54 at this time, they will never impede drawing of the ring portion 7. After that, the ring portion 7 is drawn a little by the drawing pin 32 so as to locate the rod portion 5 between the tips of the claw portions 42, thereby becoming ready for separation of wire heald B (see FIG. 11). At this time, the magnetic head 31 is moved horizontally until the drawing pin 32 comes to below a drop preventing plate 66 standing by in front of the heald drawing opening 9, whereby cooperation of the drop preventing plate 66 with the magnetic head 31 prevents the ring portion 7 of the lowermost wire heald B from slipping out.

Figure 14:
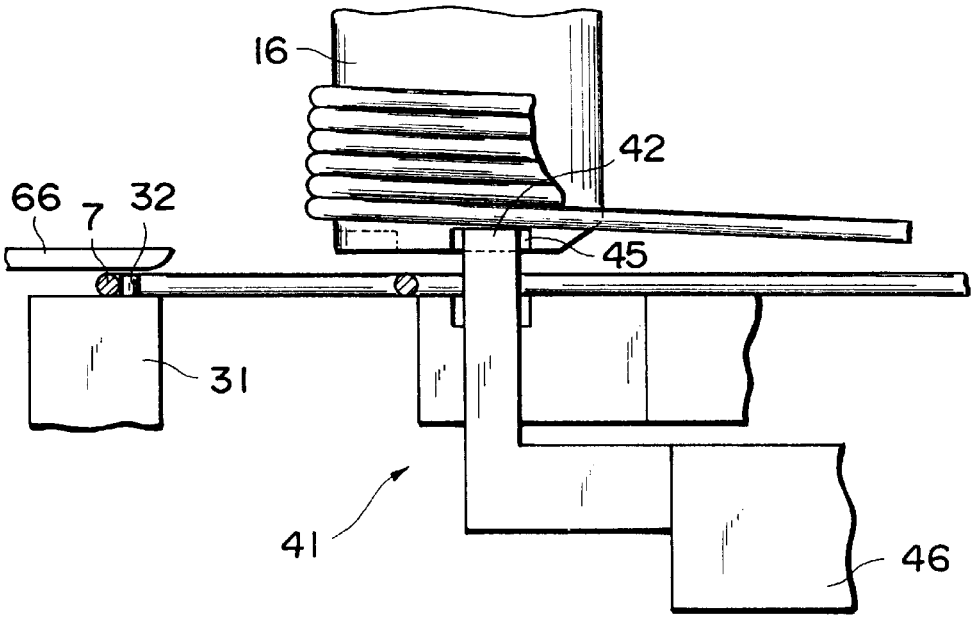
FIG. 14 is a partly enlarged side view to show a state in which the lowermost wire heald is drawn slightly out.
Figure 15:
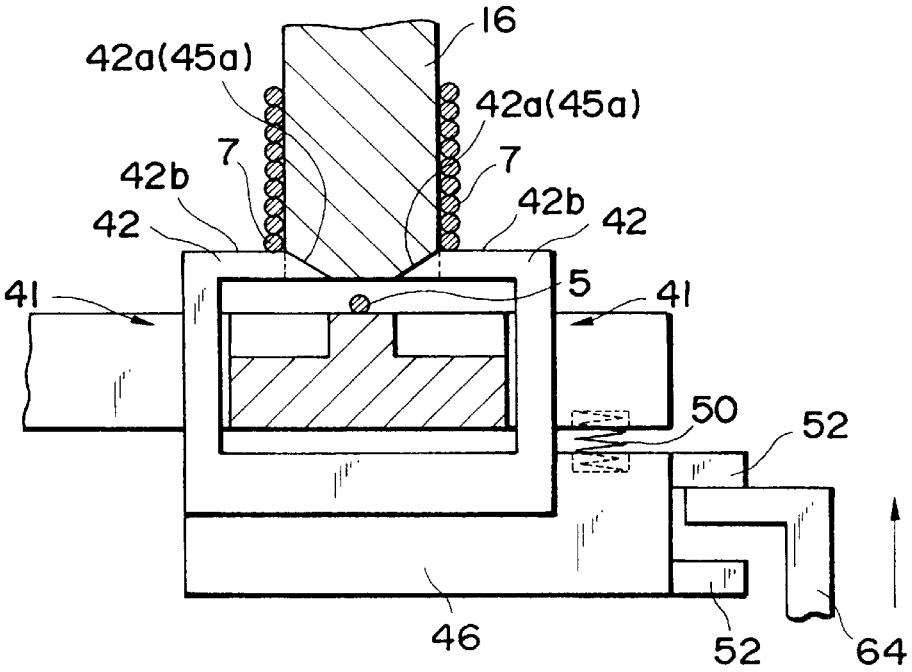
FIG. 15 is a transverse cross-sectional view of FIG. 15.

After that, the air cylinder 62 is driven to move the actuator member 64 up as shown in FIG. 14 and FIG. 15, so that the tip of the actuator member 64 pushes the upper tongue 52 up to lift the base portion 46 by a predetermined amount against spring force of the compression spring 50. Since at this time the rod portion 5 of the lowermost wire heald B passes through the gap 44 between the claw portions 42 with ascent of the push claws 41, the lowermost wire heald B continuously keeps its position without being affected by ascent of the push claws 41. Then the tip portions of the claw portions 42 are inserted into the claw engaging recesses 45 of the front floating rod 16 to make the taper faces 42*a* and 45*a* fitting with each other and then to lift the front floating rod 16.

Further, the ring portions 7 of the stacked wire healds B are also lifted utilizing the top faces 42*b* of the claw portions 42. This results in lifting the ring portions 7 in the stacked state as mounted on the floating rod 16 and kept at the position thereof together with the floating rod 16, whereby only the lowermost wire heald B can be separated from the other wire healds B at the place of the-front floating rod 16. Then cooperation of the drop preventing plate 66 with the magnetic head 31 achieves smooth drawing of the lowermost wire heald B and hooks the lowermost ring portion 7 on the drawing pin 32. After the lowermost wire heald B is drawn out completely, the air cylinder 62 is driven to move the actuator member 64 down, so as to return the base portion 46 to the position of FIG. 13 by the spring force of the compression spring 50, thus preparing for the next drawing operation.

Figure 24:
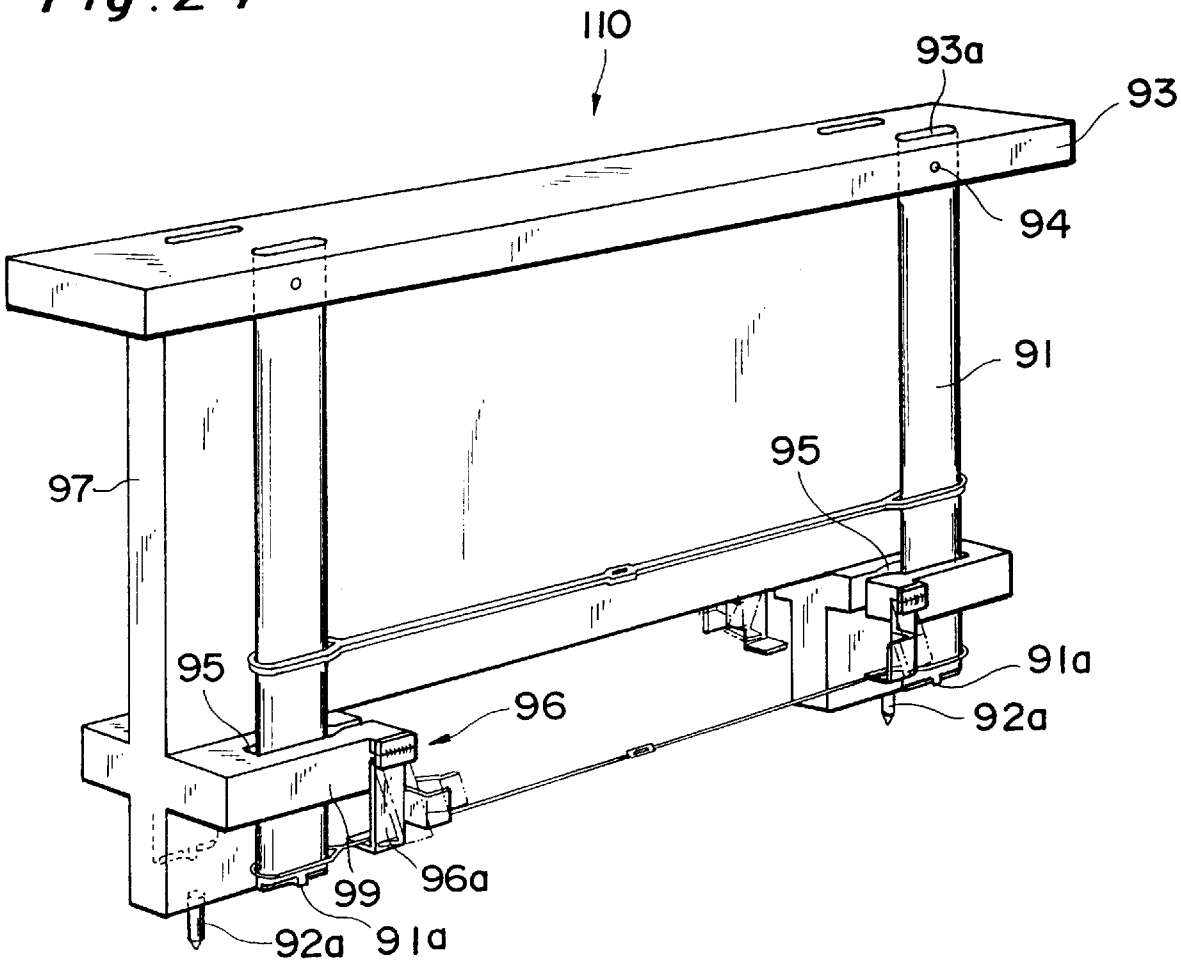
FIG. 24 is a perspective view of a cartridge to be mounted on the stocker shown in FIG. 6.

The easy insertion of the wire healds into the stocker can be realized by using a cartridge 110 as shown in FIG. 24. In order to make the mount of the cartridge 110 on the stocker 11 easy, as shown in FIG. 6, a cruciate groove 98 is formed on a top of the floating rod 16 and a hole 92*b* is formed on a top of the ring receiving portion 14. They are utilized for positioning the cartridge to the stocker in the~mounting operation. The cartridge 110 has a top support plate 93, storing rod 91 and a side support plate 97. The storing rod 91 is inserted into a hole 93*a* provided on the top support plate 93 and is supported by a pin 94. Therefore the storing rod 91 is slightly swingable around the pin 94, but slight movement enables an operator to easily mount the cartridge on the stocker. The side support plate 97 has a projection portion 99 and the projection portion 99 has a through hole 95 through which the storing rod 91 passes. An opening of the through hole 95 is slightly larger than a figure of the ring portion 7 of the wire heald in which the storing rods 91 fill and therefore, although the storing rod 91 can slightly move in the through hole 95. The storing rod 91 is positioned so that a longitudinal direction of the storing rod 91 is kept along a vertical direction because the space between the storing rod 91 and an inner surface of the through hole 95 can be filled with the wire heald stored in the cartridge 110. The projection portion 99 has a spring hinge 96 for an arm 96*a* for supporting the wire heald stored in the cartridge 110 therein. The arm 96*a* is positioned as shown in a solid line of FIG. 24 normally and at the position, the arm 96*a* supports the wire heald therein Next in the insertion of the wire heald into the -stocker, the arm 96*a* is moved to a position as shown in chain double-dashed lines of FIG. 24 by an actuator (not shown). At this position, the supporting of the arm 96*a* is released and therefore the stored wire healds fall down into the stocker 11. The storing rod 91 has a cruciate projection 91*a* in the bottom thereof and the cruciate projection 91*a* matches with the cruciate grooves 98 of the floating rod 16 in mounting of the cartridge to the stocker. Further, the side supporting plate 97 has a pin 92*a* extending downwardly from the bottom thereof and the pin 92*a* is inserted into the hole 92*b* of the ring receiving portion 14 in the mounting of the cartridge 110 to the stocker 11. By the both of the engagement of the cruciate projection 91*a* and the crucite groove 98 and the engagement of the pin 92*a* and the hole 92*b*, the cartridge 110 is positioned to the stocker accurately.

Figure 25:
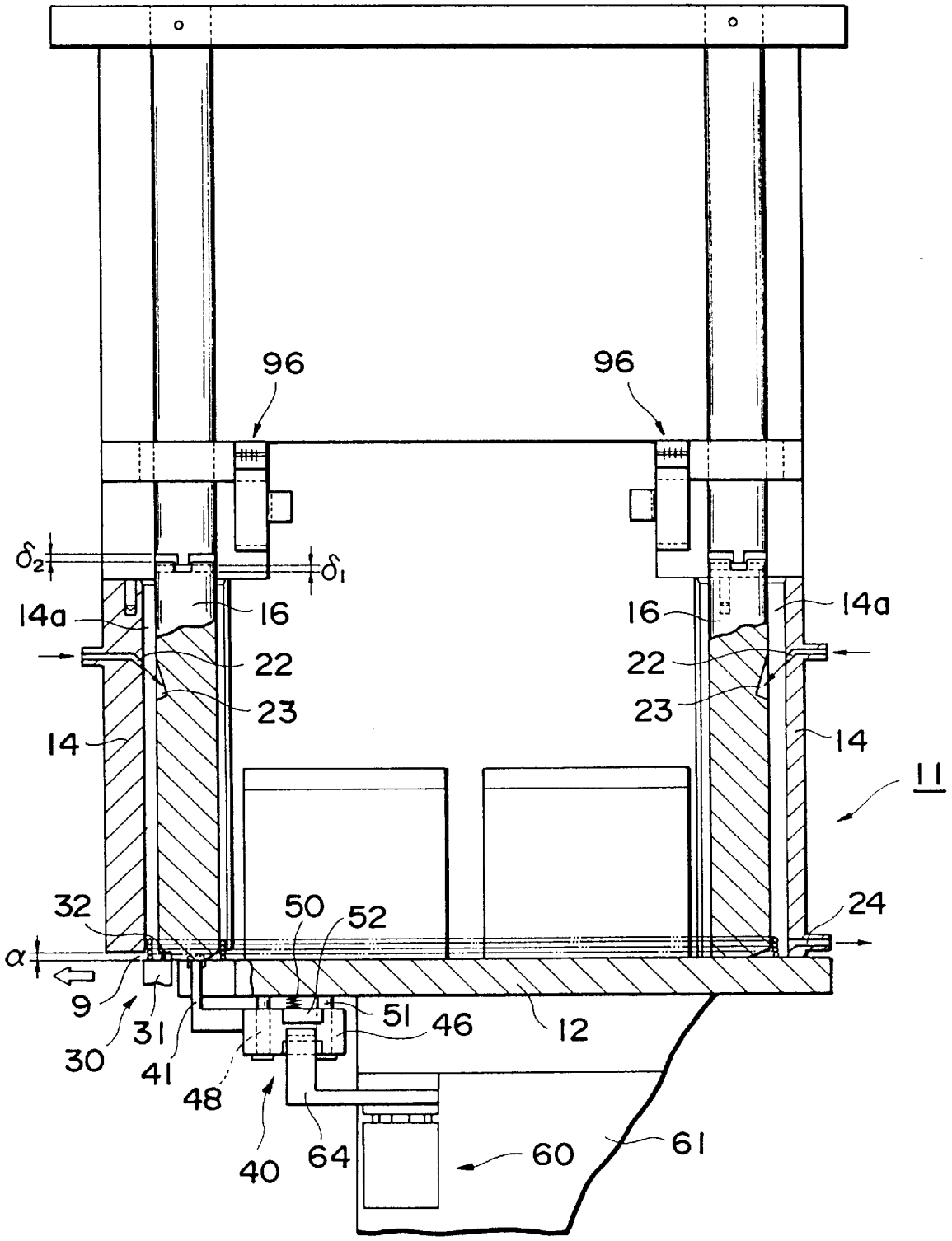
FIG. 25 is a side view to show the combination state under which the cartridge shown in FIG. 24 is mounted on the stocker shown in FIG. 6.

FIG. 25 shows the combination state under which the cartridge 110 is mounted on the stocker 11.

Next the insertion operation of the wire healds stored in the cartridge 110 into the stocker 11 will be explained.

Firstly, the wire healds are inserted around the storing rod 91 from downside thereof, passing through the space 95 and stored therein. In this stage, the arm 96*a* is positioned as shown in the solid lines of FIG. 24 to support the stored wire healds around the storing rod 91. Next, the cartridge 110 is mounted on the stocker 11 so that the cartridge 110 is positioned on the stocker 11 by engaging the pin 92*a* with the holes 92*b* and engaging the cruciate projections 91*a* with the cruciate grooves 98. Next the arm 96*a* is moved by the actuator (not shown) to the position shown in the chain double-dashed lines of FIG. 24 so that the stored wire healds fall down into the stocker 11. Lastly, in the pulling out of the lowest wire heald from the stocker, the floating rod 16 is moved up by a predetermined distance and the predetermined distance should be smaller than the clearances 81 and 82 in FIG. 25.

The stocker for wire healds according to the present invention is by no means limited to the above-stated embodiment.

Figure 16:
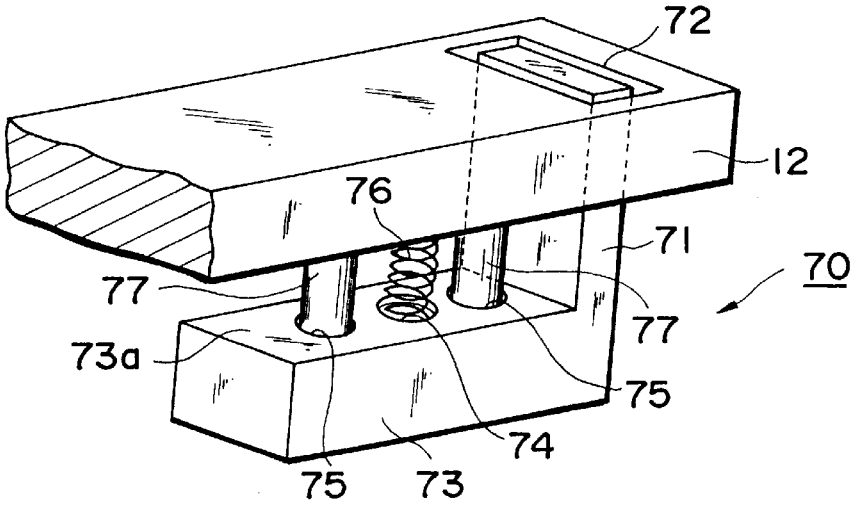
FIG. 16 is a perspective view to show the heald rear end separating portion.
Figure 17:
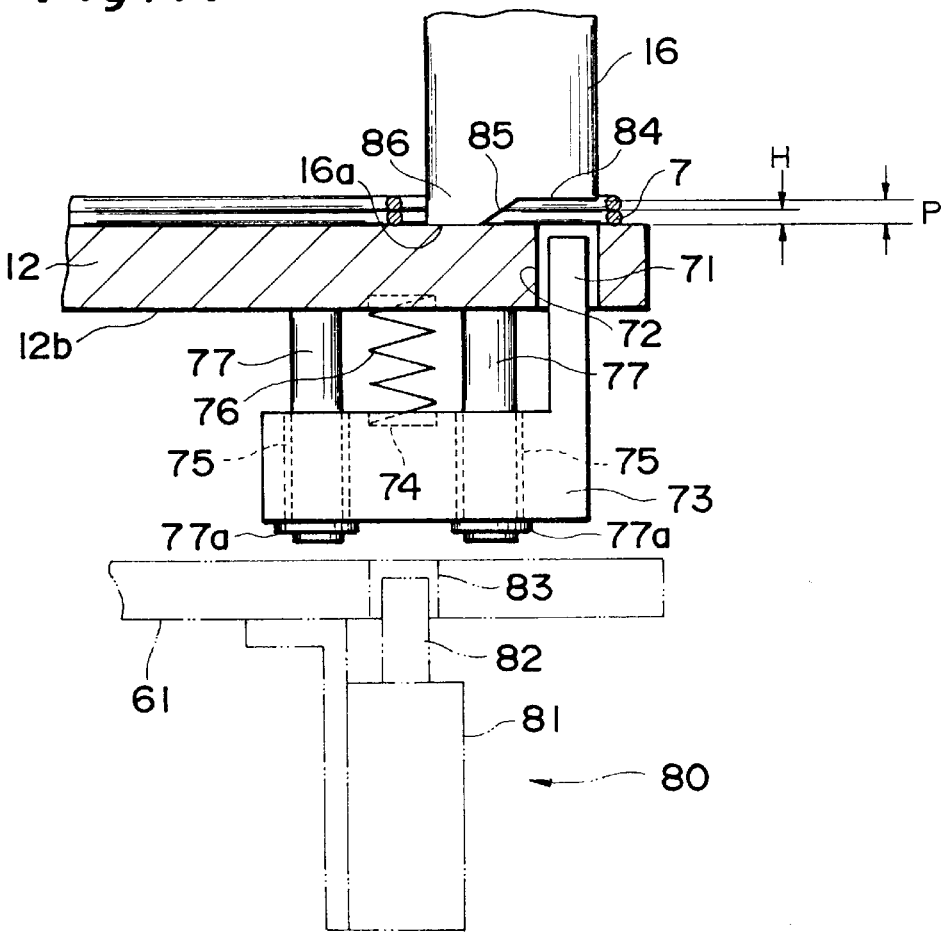
FIG. 17 is a side view to show the heald rear end separating portion.

For example, as shown in FIG. 16 and FIG. 17, the wire heald stocker 10 is provided with a heald rear end separating portion 70 forming a heald pusher as a lift head in order to assure more certain drawing of the lowermost wire heald B. This heald rear end separating portion 70 has a block-shaped lift member 71 located below the rear floating rod 16 and extending vertically. Below the rear floating rod 16, this lift member 71 is inserted into a rectangular aperture 72 formed in the base 12 from the bottom and stands on a base portion 73 located below the base 12.

A recess 74 for a spring to be seated is formed in a top surface 73*a* of this base portion 73, and pin inserting holes 75 vertically piercing the base portion 73 are formed on either side of the recess 74. Also, the top surface 73*a* of the base portion 73 and the bottom surface 12*b* of the base 12 are connected through a compression spring 76 seated in the recess 74, and this compression spring 76 urges the base portion 73 in the direction to depart from the base 12. Then two pins 77 are provided so as to project from the bottom surface 12*a* of the base 12, the pins 77 are inserted in the pin inserting holes 75 of the base portion 73, and stopper portions 77*a* comprised of snap rings or the like are provided at the lower ends of the pins 77, whereby the base portion 73 can be moved vertically in the extending direction of the pins 77 under elasticity of the spring 76.

Here, the base portion 73 is moved vertically by a driver 80 and this driver 80 is located immediately below the base portion 73. This driver 80 comprises an air cylinder 81 fixed through a bracket or the like to a portion of a support stage 61 for supporting the base 12 of the housing 11, and a cylinder rod 82 arranged to vertically reciprocate in a predetermined stroke~relative to this air cylinder 81. The tip of this cylinder rod 82 is inserted from the bottom into an aperture 83 formed in the support stage 61 below the base portion 73, so as to face the bottom surface of the base portion 73. Then the cylinder rod 82 is made to project from the aperture 83, so that the tip of the cylinder rod 82 pushes the base portion 73 up, thereby lifting the base portion 73 and lift member 71. Then the cylinder rod 82 is moved down to bury the cylinder rod 82 in the aperture 83, whereby the base portion 73 and lift member 71 arc moved down by the urging force of the spring 76.

Figure 18:
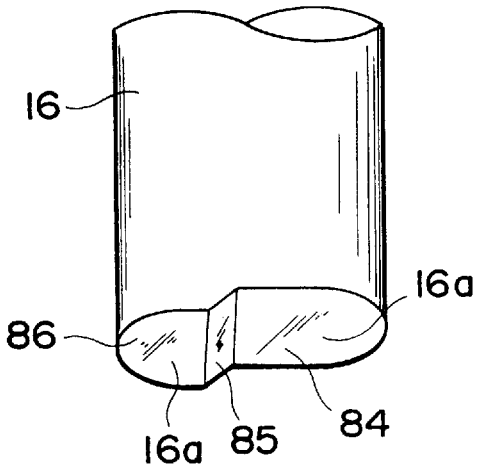
FIG. 18 is a perspective view to show the lower end portion of the rear floating rod.

As shown in FIG. 17 and FIG. 18, a ring lead-in portion 84 cut horizontally is formed at the rear part in the lower end face 16*a* of the rear floating rod 16, and this ring lead-in portion 84 has a cut depth P a little larger than the height H of one ring portion 7. A protrusion 86 projecting in the direction of the axis is formed at the front part in the lower end face 16*a* of the rear floating rod 16, and the lower end face 16*a* on the side of this protrusion 86 is connected through a taper face 85 with the lower end face 16*a* on the side of the ring lead-in portion 84. In order to surely insert only the lowermost ring portion 7 into the ring lead-in portion 84, the cut depth P is made to be smaller than the height 2H of two ring portions 7.

Next explained is the operation of the heald rear end separating portion 70.

Figure 19:
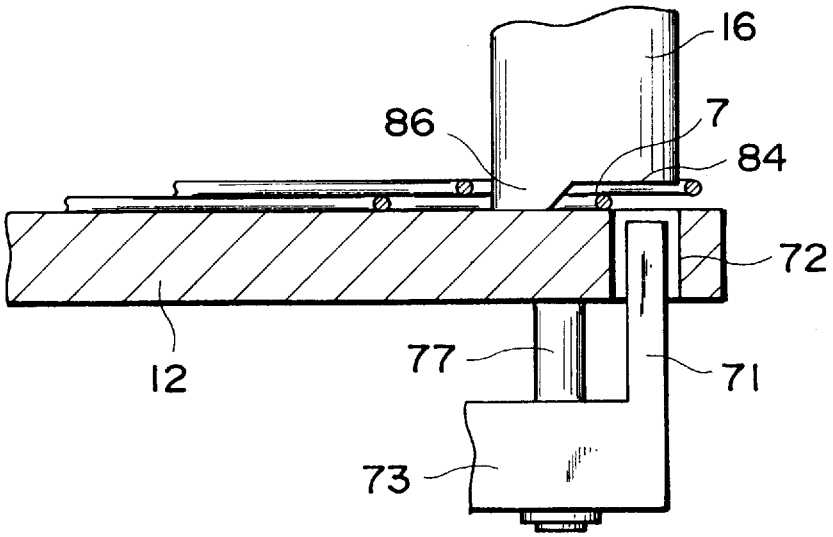
FIG. 19 is a partly enlarged side view to show a state in which the lowermost wire heald is drawn slightly out.
Figure 20:
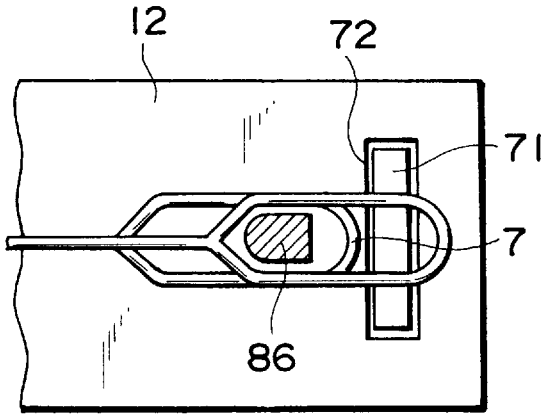
FIG. 20 is a plan view corresponding to the figure of FIG. 19.

As shown in FIG. 12 and FIG. 13, prior to draw of the lowermost wire heald B. first, the drawing pin 32 is inserted into the notch portion 16*b* of the front floating rod 16 and at the same time as it, the front ring portion 7 of the lowermost wire heald B is made to be magnetically attached to the magnetic head 31. Since the claw portions 42 of the push claws 41 are buried completely in the claw receiving recesses 54 at this time, they will never impede drawing of the front ring portion 7. After that, the front ring portion 7 is drawn out a little by the drawing pin 32 (see FIG. 11). At this time, as shown in FIG. 19 and FIG. 20, the rear end of the rear ring portion 7 in the lowermost is led into the ring lead-in portion 84 of the rear floating rod 16 as passing above the aperture 72 of the base 12, and thus, the ring portion 7 does not collide with the floating rod 16, thereby preventing the floating rod 16 from moving up. Further, the protrusion 86 of the rear floating rod 16 is located still in the lowermost ring portion 7.

Figure 21:
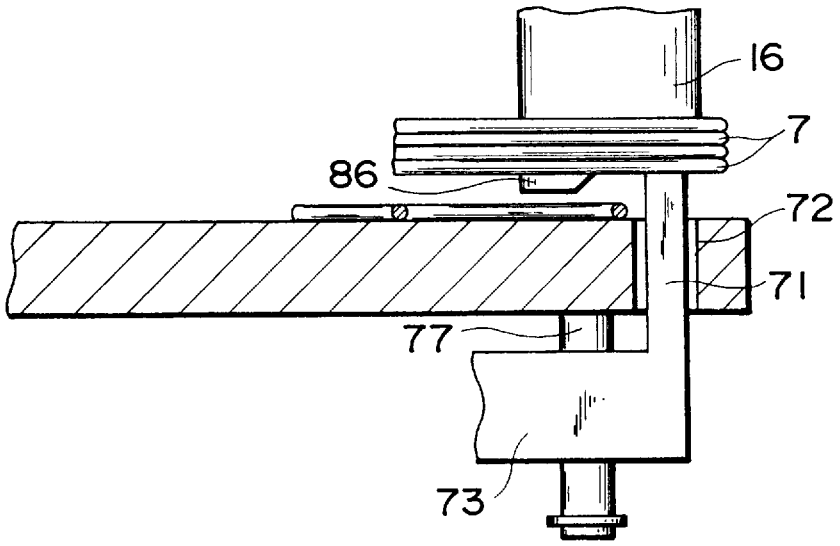
FIG. 21 is a side view to show a state in which the rear floating rod is lifted by the heald rear end separating portion.
Figure 22:
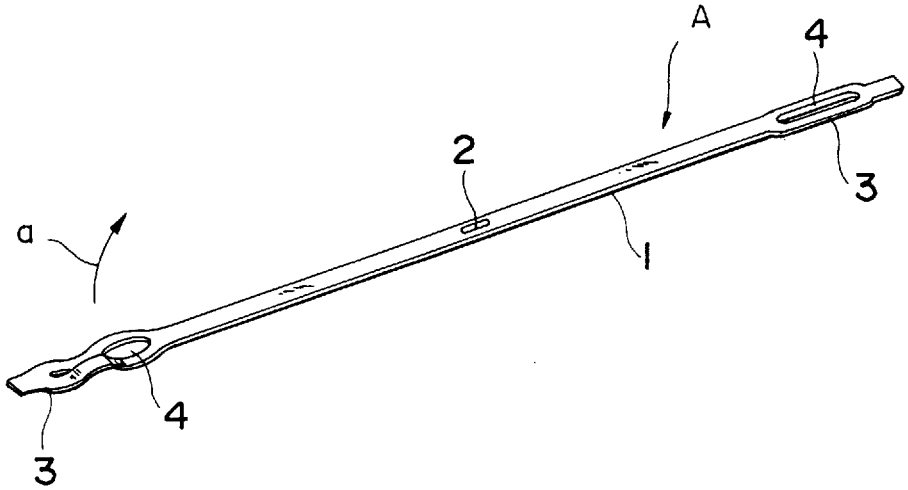
FIG. 22 is a perspective view to show an example of the flat heald.
Figure 23:
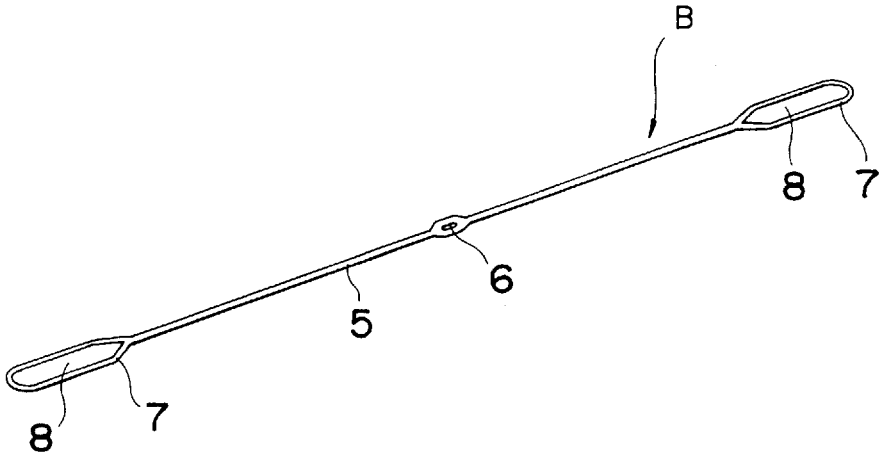
FIG. 23 is a perspective view to show an example of the wire heald.

After that, as shown in FIG. 21, the air cylinder 81 is actuated to push the base portion 73 up by the tip of the cylinder rod 82, whereby the base portion 73 moves up while the lift member 71 also moves-up as~following it. As a result, as the top surface of the lift member 71 lifts the ring portions 7 in the stacked state, having been mounted on the floating rod 16 and kept at that position and the lower end face 16*a* on the side of the ring lead-in portion 84 simultaneously, the protrusion 86 inserted in the lowermost ring portion 7 is also lifted. Accordingly, the protrusion 86 is spaced away from the base 12, which completely releases engagement between the lowermost ring portion 7 and the floating rod 16. After that, the drawing pin 32 is further advanced, so that the lowermost wire heald B is drawn out smoothly without collision between the rear floating rod 16 and the lowermost ring portion 7. After completion of such drawing of wire heald B. the cylinder rod 82 is moved down to make the tip of the cylinder rod 82 buried in the aperture 83, thereby moving the base portion 73 and lift member 71 down by the urging force of the spring 76.

Therefore, since the rear floating rod 16 is kept from colliding with the lowermost ring portion 7 upon drawing of the lowermost wire heald B. no abrasion occurs between the lower end face 16*a* of the floating rod 16 and the wire heald B. Also, upon drawing of wire heald B at extremely high speeds, repetitive collision can be avoided between the floating rod 16 and the wire heald B. which can prevent an excessive load from being exerted on the wire heald B. which in turn prevents the wire heald B from being deformed, and which thus can lengthen the lifetime of wire heald B itself.

The stocker for wire healds according to present invention can be modified for example as described below within the scope not departing from the spirit of the present invention without having to be limited to only the above-stated embodiment.

(1) In the foregoing embodiment, the block-shaped lift member 71 may be formed in a claw shape, in a cylindrical shape, or in a hollow shape of the foregoing in order to reduce the weight thereof.

Figure 26:
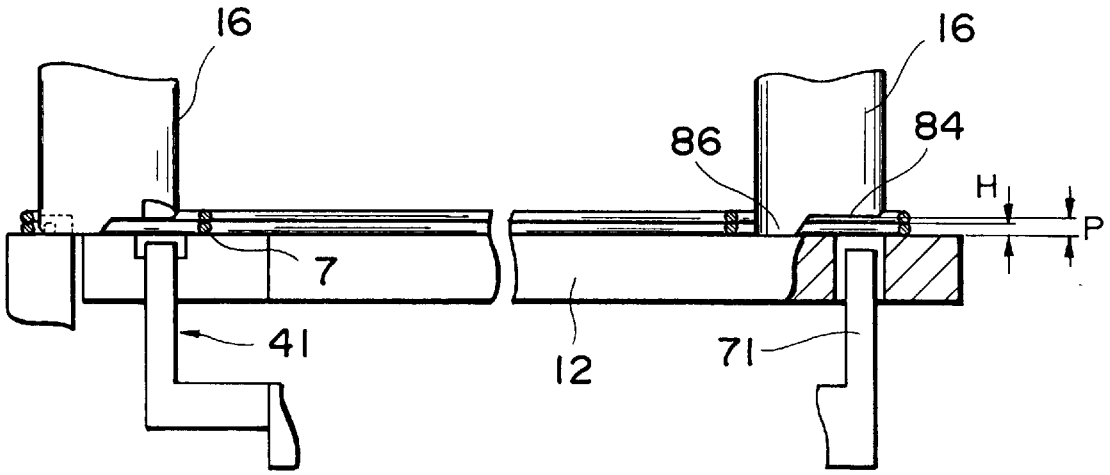
FIG. 26 is a side view of the modified embodiment in which the ring lead-in portion cut horizontally may be applied to the fron floating rod.
Figure 27:
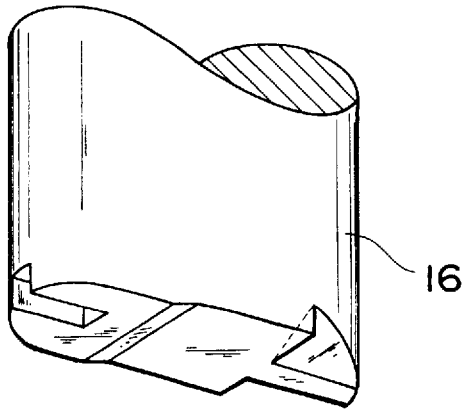
FIG. 27 shows the lower surface of the floating rod in the modified embodiment.

(2) In the foregoing embodiment, the ring lead-in portion 84 cut horizontally may be applied to the front floating rod 16. In the case, the side view thereof is shown in FIG. 26 and the lower surface of the floating rod 16 is shown in FIG. 27.

(3) In the foregoing embodiment, a plurality of frame bodies 13 may be arranged as juxtaposed on the base 12. In such an arrangement, the wire healds B may be drawn out one by one in order from the ends of plural frame bodies 13 juxtaposed or may be drawn one each at a time from the all frame bodies 13 juxtaposed.

The stocker for wire healds according to the present invention can attain the following effects because it is arranged as described above.

Namely, by the arrangement in which the wire healds kept in a horizontal state are stacked vertically in the housing, in which the heald refilling aperture is provided at the top portion of the housing, and in which the heald drawing opening for discharging the lowermost of the stacked wire healds in the horizontal direction is provided at the lower front end in the housing, stable stocking of wire healds in the housing can be insured. Further, upon the refilling operation of wire healds, the refilling operation can be performed from the top of the housing as utilizing the self-weight of healds or the like, and thus the refilling operation of wire healds becomes easy. Also, the refilling operation can also be carried out as looking into the heald refilling aperture from the top. Further, by the arrangement in which the heald drawing opening is provided at the lower front end of the housing, the wire heald can be drawn horizontally as maintained in the horizontal state, with hooking the guide hole of the lowermost wire heald on the pin or the like. Also, employment of the floating rods can prevent entanglement of wire healds in the housing.

Further, provision of the heald front end separating portion in the stocker can decrease such a tendency that upon drawing of the lowermost wire heald the wire heald above it is also drawn together therewith by the drawing force of the lowermost wire heald, and can prevent the rear ring portion of the lowermost wire heald from vertically moving the front floating rod. Further, the total weight of the stacked wire healds and the weight of the floating rods is considerably greater than the drawing force of wire heald. Thus, use of the push claws upon drawing of the lowermost wire heald can minimize influence of the stacked wire healds and the floating rods, whereby the lowermost wire heald can be drawn out smoothly.

By the arrangement in which the taper faces are formed at the tips of the claw portions, in which the claw engaging recesses for the tip portions of the claw portions to be inserted therein are formed in the lower end faces of the floating rod, and in which the taper faces arranged to match with the taper faces of the claw portions are formed in the top surface of the claw engaging recesses, even if the floating rod is set in such a state with a play as to move vertically and horizontally in the housing, engagement between the taper faces of the claw portions and the taper faces of the claw engaging recesses can assure certain lift of the floating rod as being positioned to the claw portions. Even if upon passing the rod portion of wire heald through the gap between the claw portions as.~moving the claw portions up, the rod portion touches the claw portion upon ascent of the push claws because the position of the rod portion is shifted from the center of the lower end face of the floating rod to the edge, the rod portion can be moved along the taper face of the claw portion, whereby the rod portion can be surely introduced into the gap between the claw portions.

Further, provision of the heald rear end separating portion in the stocker can decrease such a tendency that upon drawing of wire heald the drawing force of the lowermost wire heald pulls the wire heald above it together therewith. By the arrangement in which the ring lead-in portion cut horizontally is provided the lower end face of the floating rod, the floating rod can be kept from colliding with the lowermost ring portion upon drawing of the lowermost wire heald, which can suppress abrasion and deformation of the floating rod and wire heald.

What is claimed is:

1. A stocker for wire healds comprising:

a housing constructed and arranged such that a plurality of wire healds can be stacked on top of one another in a vertical direction and be arranged so as to longitudinally extend in a horizontal direction;

said housing including a heald refilling aperture at an upper portion thereof, said housing including a heald drawing opening at a lower front end thereof, said heald drawing opening being positioned and configured such that a lowermost one of said plurality of wire healds can be discharged therethrough.

2. A stocker for wire healds according to claim 1, wherein a pair of front and rear floating rods are disposed in said housing such that ring portions of said wire healds can be slid over said floating rods, said floating rods having lower end faces disposed in contact with a heald receiving bottom surface of said housing, said floating rods being arranged to travel vertically in said housing.

3. A stocker for wire healds according to claim 2, wherein a tapered ring lead-in portion for leading said ring portion between said lower end face of an associated one of said floating rods and said heald receiving bottom surface is formed at a rear part of the lower end face of each of said floating rods.

4. A stocker for wire healds according to claim 2, wherein a horizontally cut ring lead-in portion is formed at a rear part in the lower end face of each of said floating rods in order pull said ring portion between said lower end face of said floating rod and said heald receiving bottom surface.

5. A stocker for wire healds according to claim 2, wherein said housing is provided with a heald front end separating portion having a pair of right and left push claws disposed below said front floating rod, said push claws being arranged to engage with said ring portion of said wire heald which has been slid over said front floating rod such that the lower end face of said front floating rod pushes said ring portion and said front floating rod upwardly from said heald-receiving bottom surface.

6. A stocker for wire healds according to claim 5, wherein each of said push claws comprises a claw portion extending horizontally to engage with the lower end face of said front floating rod and with said ring portion slid over said front floating rod, each of said push claws comprising a support portion for supporting said claw portion, wherein left and right tip portions of said claw portions are spaced from each other.

7. A stocker for wire healds according to claim 6, wherein a taper surface is formed at the tip of said claw portion, a claw engaging recess for the tip portion of said claw portion to be inserted therein is formed in the lower end face of said floating rod, and a taper surface fitting with the taper surface of said claw portion is formed in an upper surface of said claw engaging recess.

8. A stocker for wire healds according to claim 5, wherein said heald front end separating portion has a base portion, said push claws extending upwardly from said base portion, wherein a spring is disposed between said base portion and a base of said housing, said spring being constructed and arranged to urge said base portion away from said base, said base portion being moved vertically by a driver.

9. A stocker for wire healds according to claim 2, wherein said housing is provided with a heald rear end separating portion having a lift member disposed below said rear floating rod, said heald rear end separating portion being constructed and arranged to engage with said ring portion of said wire heald in which said rear floating rod is inserted and with the lower end face of said rear floating rod to push the said ring portion and said rear floating rod in an upward direction.

10. A stocker for wire healds according to claim 9, wherein said heald rear end separating portion has a base portion, said lift member extending upwardly from said base portion wherein a spring is disposed between said base portion and a base of said housing, said spring being constructed and arranged to urge said base portion away from said base, said base portion being moved vertically by a driver.

11. A stocker for wire healds according to claim 2, wherein ring receiving portions for receiving said floating rods are provided at opposing ends of said housing.

12. A stocker for wire healds according to claim 11, wherein an air blow-off port for blowing off compressed air toward said floating rod is provided in an upper part of said ring receiving portion and an air catch recess opposed to said air blow-off port to catch the compressed air from said blow-off port is formed in an upper part of said floating rod.

13. A stocker for wire healds according to claim 11, wherein an air suction portion for sucking the ring portions of said wire healds mounted on said floating rod backward is provided in a lower part of said ring receiving portion located in a rear part of said housing.

14. A stocker for wire healds according to claim 2, wherein said housing is provided with a rod receiving slit for receiving rod portions of said wire healds.

15. A stocker for wire healds according to claim 14, wherein a ring guide hole for enabling horizontal drawing of said ring portion of said lowermost wire heald is formed at a lower end of said rod receiving slit by expanding said rod receiving slit in a horizontal direction.

16. A stocker for wire healds according to claim 15, wherein said housing has a mail receiving space portion for receiving mails of said wire healds at a position where said rod receiving slit is separated into front and rear slits, wherein a heald escape recess is formed in said heald receiving bottom surface to expand a lower part of said mail receiving space portion.

17. A stocker for wire healds according to claim 2, further comprising a cartridge mountable on top surfaces of said front and rear floating rods, said top surfaces of said floating rods having cruciate grooves, surfaces of said cartridge which engage said top surfaces of said floating rods having cruciate projections configured to engage with said cruciate grooves.

* * * * *